US008561437B2

(12) United States Patent
Lee et al.

(10) Patent No.: US 8,561,437 B2
(45) Date of Patent: Oct. 22, 2013

(54) WASHING MACHINE AND SOUND CONTROL METHOD THEREOF

(75) Inventors: Joo Yeon Lee, Seoul (KR); Hyun Jin Kim, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 994 days.

(21) Appl. No.: 12/232,256

(22) Filed: Sep. 12, 2008

(65) Prior Publication Data

US 2009/0282874 A1 Nov. 19, 2009

(30) Foreign Application Priority Data

May 16, 2008 (KR) ..... 10-2008-0045604

(51) Int. Cl.
*D06F 33/00* (2006.01)

(52) U.S. Cl.
USPC ..... 68/12.02; 68/58; 381/71.3

(58) Field of Classification Search
USPC ..... 68/12.02, 12.06, 24, 58; 8/158, 159; 381/73.1, 94.1
See application file for complete search history.

(56) References Cited

U.S. PATENT DOCUMENTS

| | | | | |
|---|---|---|---|---|
| 5,129,003 | A * | 7/1992 | Saruta | 381/71.3 |
| 6,654,467 | B1 * | 11/2003 | York et al. | 381/71.14 |
| 2003/0037382 | A1 * | 2/2003 | Broker | 8/158 |
| 2005/0114081 | A1 * | 5/2005 | Fukui | 702/182 |

FOREIGN PATENT DOCUMENTS

KR 10-2002-0040267 * 5/2002

* cited by examiner

*Primary Examiner* — Saeed T Chaudhry
(74) *Attorney, Agent, or Firm* — Staas & Halsey

(57) ABSTRACT

Disclosed herein are a washing machine and a sound control method thereof that are capable of canceling noise generated during an operation of the washing machine and, at the same time, informing a user of information related to the operation of the washing machine using a sound. The sound control method includes operating the washing machine according to an inputted operation command, sensing noise generated during the operation of the washing machine, reading a sound to cancel the sensed noise, and outputting the read sound in a state in which the read sound is mapped with the noise. Consequently, it is possible mask the noise, thereby minimizing the noise. Also, it is possible to sense a start and an end of each operation and a change of the operation based on the noise pattern, sense a user's access to the washing machine, and output a feedback sound, thereby informing of the progress information of the washing machine.

24 Claims, 9 Drawing Sheets

WASHING MACHINE AND SOUND CONTROL METHOD THEREOF

CROSS-REFERENCE TO RELATED APPLICATIONS

This application claims the benefit of Korean Patent Application No. 2008-0045604, filed on May 16, 2008 in the Korean Intellectual Property Office, the disclosure of which is incorporated herein by reference.

BACKGROUND

1. Field

The present invention relates to a washing machine and a sound control method thereof, and, more particularly, to a washing machine and a sound control method thereof that are capable of canceling noise generated during the operation of the washing machine and, at the same time, informing a user of information related to the operation of the washing machine using a sound.

2. Description of the Related Art

Generally, a washing machine (normally, a drum-type washing machine) is a machine including a water tub to receive water (wash water or rinse water), a cylindrical drum rotatably mounted in the water tub to receive laundry, and a motor to generate a drive force necessary to rotate the drum, which lifts the laundry along the inner wall of the drum and drops the laundry, during the rotation of the drum, to wash the laundry.

The washing machine performs washing through a series of operations, e.g., a washing operation to separate contaminants from the laundry with water containing detergent (specifically, wash water), a rinsing operation to rinse out bubbles or residual detergent from the laundry with water containing no detergent (specifically, rinse water), and a spin-drying operation to spin-dry the laundry at high speed. At the washing operation and the rinsing operation, a water supply process to supply water and a water drainage process to drain water are performed.

When the laundry is washed according to the respective operations, noise may be generated from the washing machine, with the result that a user may feel displeased.

A method of reducing noise generated during the operation of the washing machine is disclosed in Korean Patent Application Publication No. 2002-0040267.

According to the Publication, the washing machine outputs a melody corresponding to noise generated during each operation to reduce the noise, thereby improving washing environment.

In such a conventional washing machine, however, it is necessary for a user to download desired melodies from a personal computer to output the melodies to reduce noise generated during the respective operations. Also, it is required to modify the structure of the washing machine, such that an interface for data exchange with an external device is mounted at the washing machine, with the result that the manufacturing costs of the washing machine are increased.

SUMMARY

Therefore, it is an aspect of the embodiment to provide a washing machine and a sound control method thereof that are capable of sensing a pattern of noise generated during an operation of the washing machine and mapping the noise pattern with a noise canceling sound to mask the noise, thereby minimizing the noise.

It is another aspect of the embodiment to provide a washing machine and a sound control method thereof that are capable of sensing a start and an end of each operation and a change of the operation based on the pattern of noise generated during the operation of the washing machine and of outputting a feedback sound, thereby informing a user of information of the present operation.

It is a further aspect of the embodiment to provide a washing machine and a sound control method thereof that are capable of outputting a feedback sound when a user accesses the washing machine, thereby informing the user of information of the present operation.

Additional aspects and/or advantages will be set forth in part in the description which follows and, in part, will be apparent from the description, or may be learned by practice of the invention.

The foregoing and/or other aspects are achieved by providing a sound control method of an electric home appliance, including operating the electric home appliance according to an inputted operation command, sensing noise generated during the operation of the electric home appliance, reading a sound to cancel the sensed noise, and outputting the read sound in a state in which the read sound is mapped with the sensed noise.

The electric home appliance may be a washing machine, and the operation of the washing machine may be at least one selected from a group consisting of water supply, washing, rinsing, drainage, spin-drying, drying, and wrinkle removal.

The sensing of the noise may include sensing a pattern of the noise generated during each operation of the washing machine.

The sensed noise pattern may be specific to each operation.

The reading of the sound may include reading information of a canceling sound previously stored in a storage unit according to the noise pattern.

The canceling sound may be a background sound or melody having an amplitude greater than that of the noise.

The outputting of the sound may include reading a canceling sound corresponding to the noise pattern from the storage unit and outputting the read canceling sound.

The sound control method may further include sensing whether abnormal noise is generated according to the noise pattern, and the outputting of the sound may include reading or creating a canceling sound corresponding to the noise pattern from the storage unit and outputting the read or created canceling sound when sensed that abnormal noise is generated.

The created sound may be obtained by adjusting the magnitude of the canceling sound according to the magnitude of the abnormal noise.

The sound control method may further include outputting a feedback sound having a frequency band different from a frequency band of the read sound.

The sound control method may further include sensing access of a user to a vicinity of the electric home appliance; and outputting the feedback sound to inform of a progress state of the operation when the access of the user is sensed.

The feedback sound may be an event effect sound or melody.

The feedback sound may be outputted at one of a start of the operation, an end of the operation, and a change in the operation to inform a user of one of the start of an operation, the end of the operation, and the change in the operation.

The foregoing and/or other aspects are achieved by providing a washing machine including a noise sensing unit to sense noise generated during an operation of the washing machine, a sound output unit outputting a sound to cancel the sensed noise, and a control unit controlling the sound output unit to output the sound in a state in which the sound is mapped with the sensed noise.

The operation of the washing machine may be at least one selected from a group consisting of water supply, washing, rinsing, drainage, spin-drying, drying, and wrinkle removal.

The noise sensing unit may sense a pattern of the noise generated during each operation of the washing machine.

The washing machine may further include a storage unit storing a canceling sound corresponding to the noise pattern, the control unit reading the canceling sound corresponding to the noise pattern from the storage unit and outputting the canceling sound in a state in which the canceling sound is mapped with the noise pattern.

The washing machine may further include a display unit to display a waveform of the outputted sound.

The washing machine may further include a user sensing unit to sense access of a user to a vicinity of the washing machine, the control unit reading and outputting a feedback sound to inform of a progress state of the operation of the washing machine from the storage unit when the access of the user is sensed.

The foregoing and/or other aspects are achieved by providing a sound control method for an electric home appliance, including: operating the electric home appliance according to one of a plurality of operation modes in accordance with an inputted operation command; sensing noise generated during the operation mode; and outputting a stored canceling sound that is mapped with the sensed noise to mask the noise generated during the operation mode.

The sound control method may further include outputting a feedback sound to inform a user of one of a start of an operation, an end of the operation, a change in the operation and a progress state of the operation when the user is sensed to be in the vicinity of the electric home appliance.

The canceling sound may be mapped with the sensed noise based on an amplitude of the sensed noise.

A specific stored canceling noise may be mapped to a specific sensed noise.

The sound control method may further include outputting a stored feedback sound having a frequency band different from a frequency band of the canceling sound at one of a start of the operation, an end of the operation, a change in the operation and a progress state of the operation when access of a user to a vicinity of the electronic home appliance is sensed.

The foregoing and/or other aspects are achieved by providing a sound control method for an electric home appliance, including: operating the electric home appliance according to one of a plurality of operation modes in accordance with an inputted operation command; and outputting a stored canceling sound that is mapped with the sensed noise to mask the noise generated during the operation mode.

BRIEF DESCRIPTION OF THE DRAWINGS

These and/or other aspects and advantages will become apparent and more readily appreciated from the following description of the embodiment, taken in conjunction with the accompanying drawings, of which.

DETAILED DESCRIPTION OF EMBODIMENT

Figure 1:
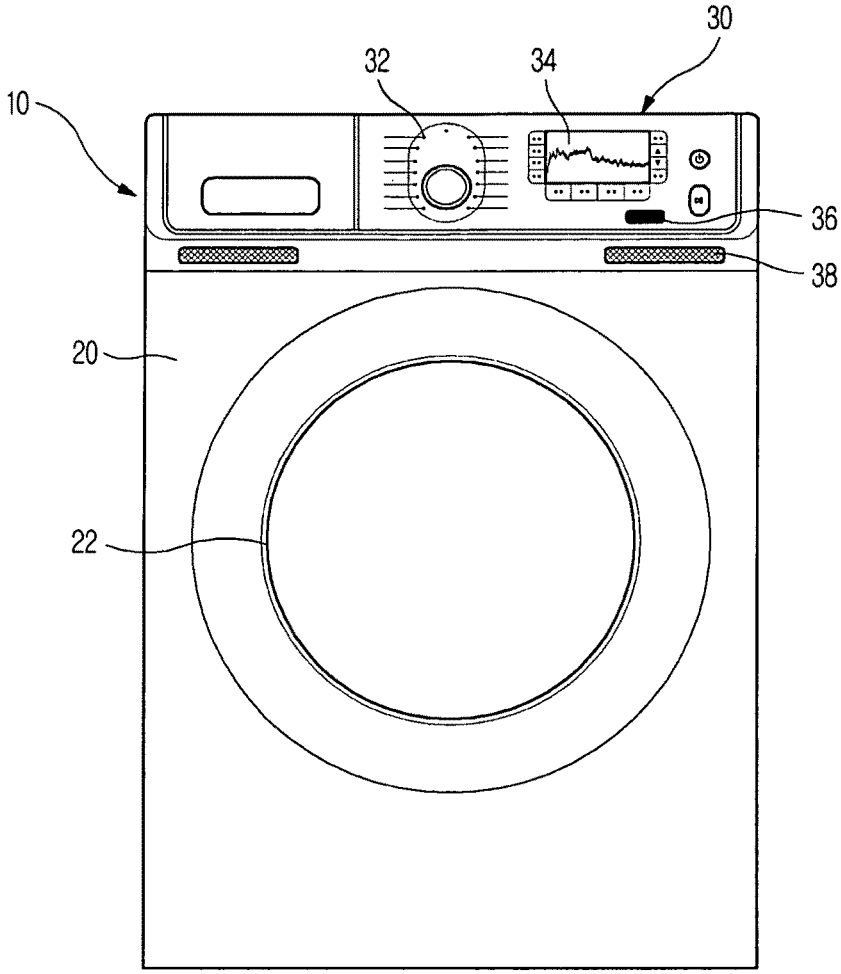
FIG. 1 is a perspective view illustrating an external appearance of a washing machine according to the present embodiment.

Reference will now be made in detail to the embodiment, examples of which are illustrated in the accompanying drawings, wherein like reference numerals refer to like elements throughout. The embodiment is described below to explain the present invention by referring to the figures.

FIG. 1 is a perspective view illustrating an external appearance of a washing machine according to the present embodiment.

Referring to FIG. 1, the washing machine includes a machine body 10 forming the external appearance of the washing machine, a front panel 20 forming a front of the machine body 10, the front panel 20 being provided at a center thereof with a door 22 through which laundry is put in, and a control panel 30 mounted above the front panel 20, for example.

The control panel 30 includes an input unit 32 to input a washing course and a command to operate the washing machine, a display unit 34 to display a washing course and a progress state of the operation of the washing machine, and a user sensing unit 36 to sense whether a user has accessed a space where the washing machine is installed. At one side of the control panel 30 is mounted a sound output unit 38 to output a sound to cancel noise generated during the operation (operation progress) of the washing machine and a feedback sound to inform of a start and an end of the operation and the progress state of the operation.

The input unit 32 includes a plurality of buttons to allow a user to input an operation command including a washing course (including a washing menu) desired by the user and the establishment of rinsing, spin-drying, drying, and wrinkle removing operations, for example.

The display unit 34 may be a liquid crystal display (LCD) that provides an initial screen on which the user selects a washing course and, after the user's selection of the washing course, displays the total operation progress time of the selected washing course such that the user can confirm the point of time when the washing is ended. The LCD is advantageous in that a light emitting diode (LED) provides limited information in a limited space, whereas the LCD flexibly provides information necessary for the user depending upon the change of a situation even in a limited space.

Also, the display unit 34 provides a waveform of a canceling sound outputted to cancel noise generated during the operation of the washing machine and a waveform of a feedback sound outputted to inform a user of the change in operation of the washing machine or the progress state of the operation of the washing machine when the user accesses the washing machine, on a screen, thereby improving a visual effect.

Figure 2:
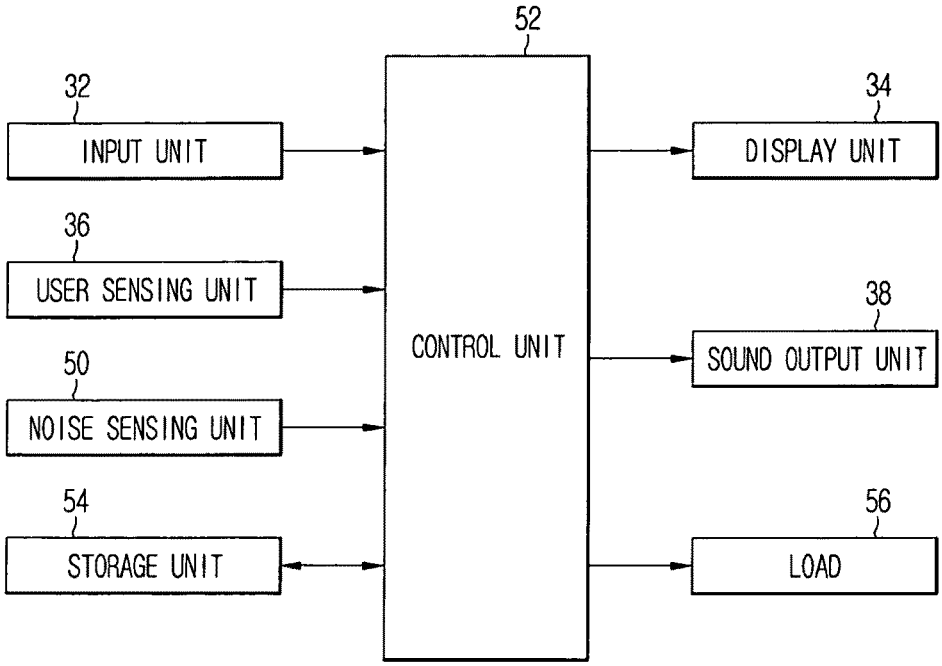
FIG. 2 is a control block diagram of the washing machine according to the present embodiment.

FIG. 2 is a control block diagram of the washing machine according to the present embodiment. The washing machine includes an input unit 32, a display unit 34, a user sensing unit 36, a sound output unit 38, a noise sensing unit 50, a control unit 52, a storage unit 54, and a load 56.

The user sensing unit 36 senses whether a user has accessed a space where the washing machine is installed. The user sensing unit 36 includes an image sensor to sense hands, shadow, or motion of the user, an infrared sensor to sense infrared rays of a specific wavelength emitted from the user, and a contact sensor to sense contact according to the manipulation of the user, for example, but may include other types of sensors that perform other sensing functions.

The sound output unit 38 outputs a sound, i.e., a background sound, to cancel noise generated during the operation (operation progress) of the washing machine and a feedback sound, i.e., an event effect sound, to inform the user of the progress state of the operation. The sound output unit 38 is implemented by a speaker to output melody or music.

The noise sensing unit 50 senses noise generated during the operation of the washing machine. Specifically, the noise sensing unit 50 senses noise generated during all possible operations, i.e., water supply, washing, rinsing, drainage, spin-drying, drying, wrinkle removal, etc., of the washing machine, e.g., the start or end of the washing machine, a repetition of the operation, supply and drainage of water, driving of the washing machine depending upon the rotation of a motor in alternating directions, using a microphone, etc.

The loudness of a sound is decided based on the amplitude of a sound wave generated by the vibration of air. Specifically, when the amplitude of the sound wave is large, the loudness of the sound is large. On the other hand, when the amplitude of the sound wave is small, the loudness of the sound is small. However, the loudness of a sound which a human being feels is based on an amount of sensation that the human being is able to perceive by hearing, which is different from the physical loudness of the sound. For this reason, the loudness of a sound physically measured is converted into the loudness of a sound that the human being is able to perceive by hearing, which is represented as decibel (dB).

Noise generated during the operation of the washing machine has different patterns specific to the respective operations as shown in FIGS. 3 to 6.

Figure 3:
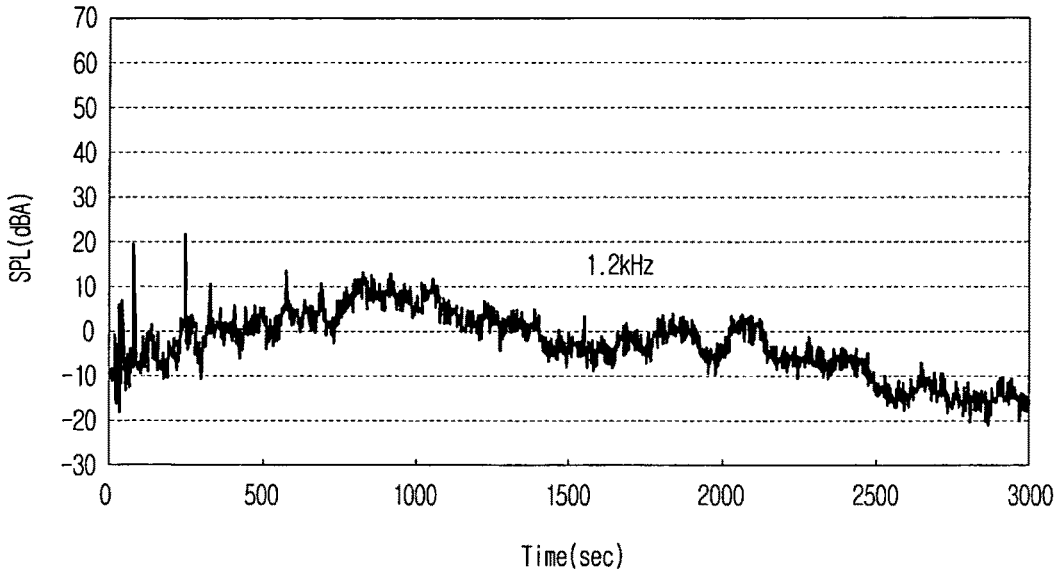
FIG. 3 is a graph illustrating a pattern of noise generated during water supply.

FIG. 3 is a graph illustrating a pattern of noise generated during water supply. During water supply, noise generated from water supplied to the washing machine according to the operation of a valve is generally generated with a specific frequency characteristic of a 1.2 KHz band (a repetitive cycle of 18 seconds), for example.

Figure 4:
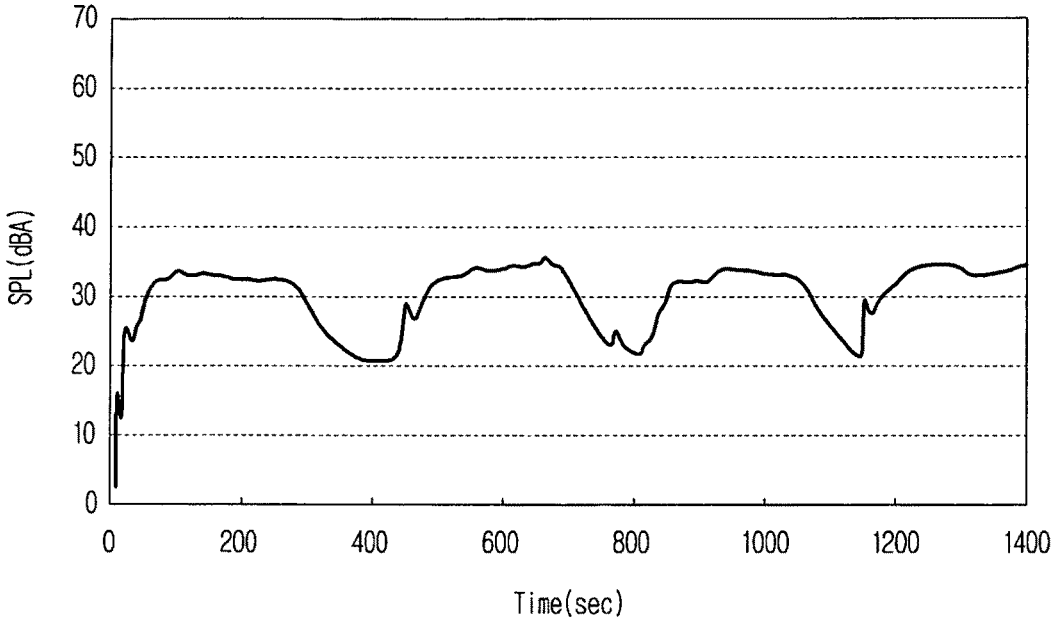
FIG. 4 is a graph illustrating a pattern of noise generated during washing.

FIG. 4 is a graph illustrating a pattern of noise generated during washing. During washing, noise generated from water moving in the washing machine according to the rotation of the motor in alternating directions, noise generated from the motor, and noise generated by the vibration of the washing machine structure are generated at a repetitive cycle of 2 seconds, for example.

Figure 5:
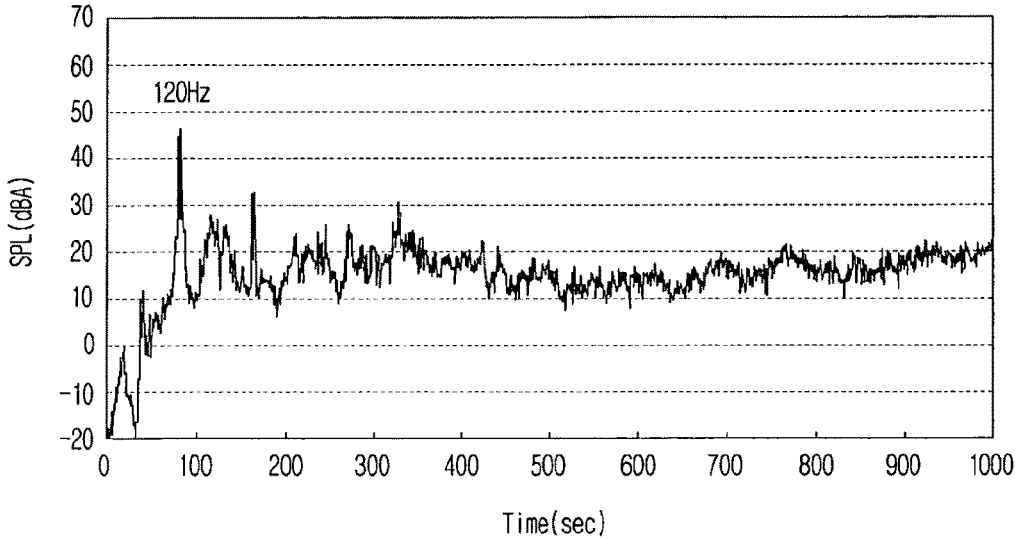
FIG. 5 is a graph illustrating a pattern of noise generated during drainage.

FIG. 5 is a graph illustrating a pattern of noise generated during drainage. During drainage, noise generated from water drained from the washing machine according to the operation of a pump and noise generated from the pump are generated with a specific pattern.

Figure 6:
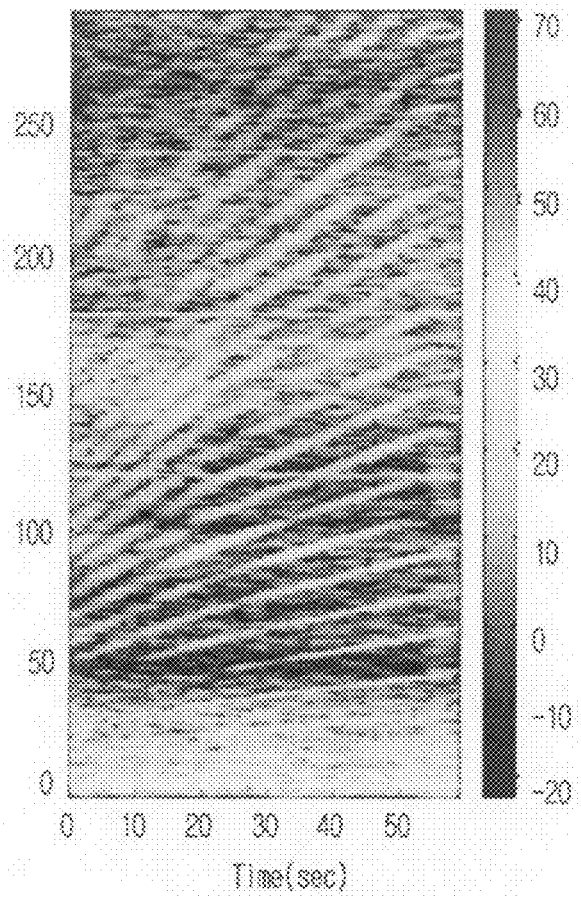
FIG. 6 is a graph illustrating a pattern of noise generated during spin-drying.

FIG. 6 is a graph illustrating a pattern of noise generated during spin-drying. During spin-drying, noise generated from water separated from laundry according to the high-speed rotation of the motor, noise generated from the motor, and noise generated by the vibration of the washing machine structure are generated with a specific pattern.

Noise generated with a specific frequency pattern for each operation of the washing machine as described above is sensed by the noise sensing unit 50, and the sensed noise is transmitted to the control unit 52.

The control unit 52 is a microprocessor that controls various loads 56, i.e., the motor, the valve, the pump, etc., according to a washing course inputted by the input unit 32 to control the overall operations of the washing machine, such as washing, rinsing, spin-drying, drying, and wrinkle removal. When noise generated during the operation of the washing machine is transmitted from the noise sensing unit 50 to the control unit 52, the control unit 52 determines the operation of the washing machine presently progressing, reads a sound (for example, a background sound) to cancel the noise from the storage unit 54, and outputs the read sound through the sound output unit 38. At this time, the control unit 52 outputs the canceling sound in a state in which the canceling sound is mapped with the noise generated with a specific pattern during the operation progress of the washing machine to mask the noise generated during the operation of the washing machine, thereby minimize the noise.

Figure 7:
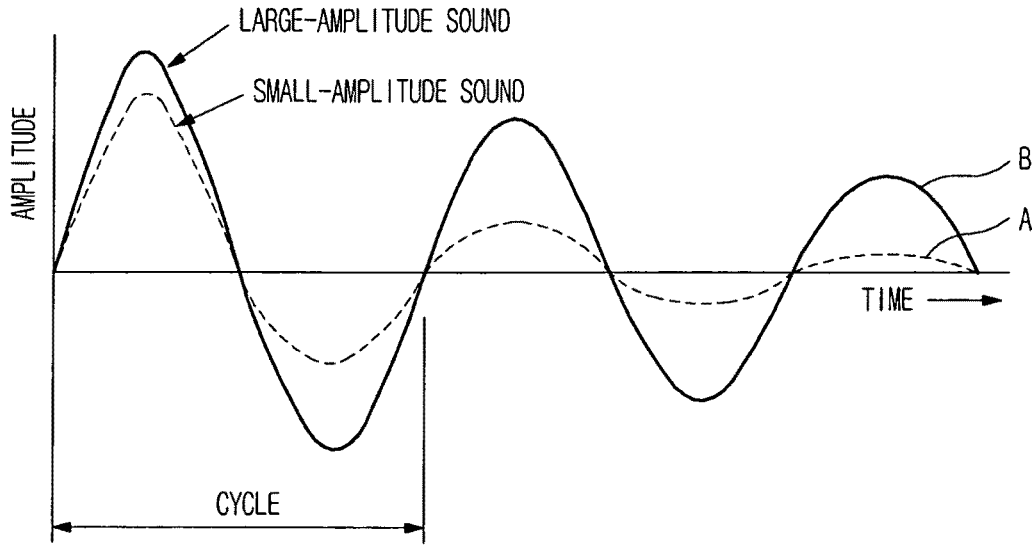
FIG. 7 is a waveform view illustrating a masking effect applied to the present embodiment.

FIG. 7 is a waveform view illustrating a masking effect applied to the present embodiment.

As shown in FIG. 7, when, during the hearing of sound "A," sound "B" having an amplitude greater than that of sound "A" is mapped, sound "A" is not heard. At this time, it is said that sound "A" is masked by sound "B." This phenomenon is referred to as a masking effect. In a quiet state, even a small sound is clearly heard. When the surrounding noise is large, even a large sound is not clearly heard.

Also, the control unit 52 analyzes a noise pattern based on the noise inputted from the noise sensing unit 50 to sense the start and end of each operation and the change of the operation, reads a feedback sound (for example, an event effect sound) to inform of the progress state of the operation from the storage unit 54, and outputs the read feedback sound through the sound output unit 38. At this time, the control unit 52 controls the canceling sound outputted to minimize the noise generated during the operation of the washing machine and the feedback sound of the present operation to be coupled and outputted, whereby a user is functionally satisfied.

Also, the control unit 52 senses whether the user has accessed the washing machine through the user sensing unit 36, reads a feedback sound (for example, an event effect sound) from the storage unit 54, and outputs the read feedback sound through the sound output unit 38, whereby the user can confirm the progress state of the operation although the user does not access the area near the washing machine. Even at this time, the control unit 52 controls the canceling sound outputted to minimize the noise generated during the operation of the washing machine and the feedback sound of the present operation to be coupled and outputted, and the user is functionally satisfied.

In addition, the control unit 52 senses whether abnormal noise, the frequency of which abruptly changes, is generated from the noise pattern inputted from the noise sensing unit 50, creates a sound to cancel the abnormal noise when the abnormal noise is generated, and outputs the sound through the sound output unit 38. The sound to cancel the abnormal noise is acquired by greatly increasing the volume level of the existing sound (a background sound or an event effect sound) stored in the storage unit 54, such that the user does not recognize the occurrence of the abnormal noise.

The storage unit 54 is a memory to store a washing course provided through the display unit 34 and the present operation state of the washing machine memorized by user's input. The storage unit 54 stores a sound to cancel noise generated differently for each operation in the form of a database, e.g., OracleLite, SQLCE, AceDB developed by Samsung Software Research Center, etc.

The canceling sound stored in the storage unit in the form of a database does not use the entire frequency band, but uses a specific frequency band (approximately 20 to 1900 Hz) to produce a sound in the form of background music (BGM). The feedback sound uses a frequency band (approximately 2000 Hz or higher), which the BGM does not have, to produce a sound. Consequently, sounds which do not interfere with each other are provided to a user.

The storage unit 54 stores a feedback sound which is outputted when the operation starts, ends, and changes and when a user accesses the washing machine in the form of a database.

In the present embodiment, the canceling sound and the feedback sound are explained to be separately stored in the storage unit 54 as an example. However, the present embodiment is not limited to such an example. For example, sound information may be stored in an inner memory of the control unit 52.

Hereinafter, the operation and effect of the washing machine with the above-stated construction and a sound control method thereof will be described.

Figure 8:
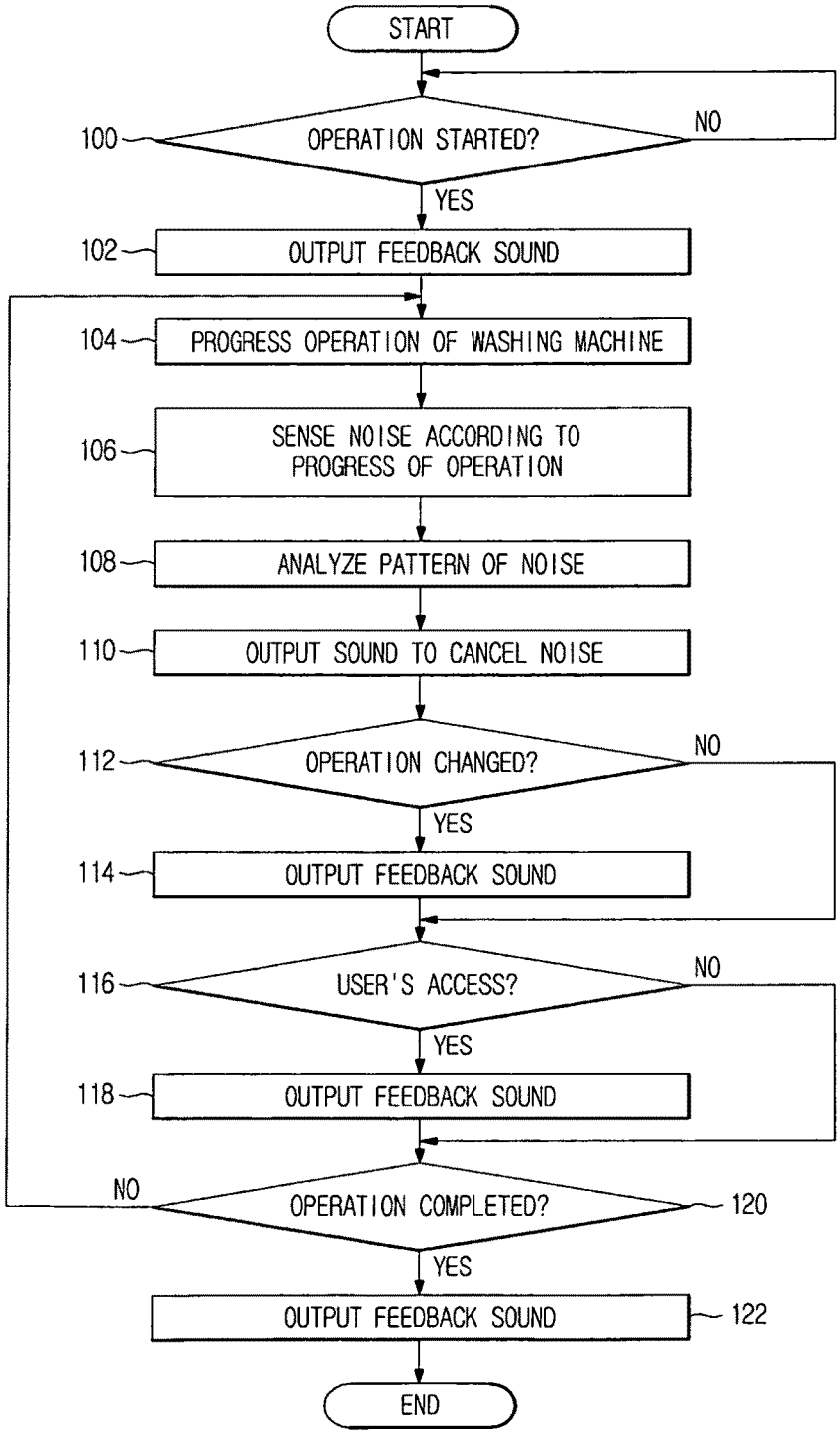
FIG. 8 is a flow chart illustrating a sound control method that cancels noise generated during each operation of the washing machine according to the present embodiment and, at the same time, informs a user of information related to the progress of each operation.

FIG. 8 is a flow chart illustrating a sound control method that cancels noise generated during each operation of the washing machine according to the present embodiment and, at the same time, informs a user of information related to the progress of each operation.

When a user puts laundry in the washing machine and selects operation information, such as a washing course, spin-drying RPM, and the addition of rinsing, which are desired by the user, the operation information selected by the user is inputted to the control unit 52 through the input unit 32.

Consequently, the control unit 52 starts to perform a series of operations, including washing, rinsing, spin-drying, drying, and wrinkle removal, according to the operation information inputted from the input unit 32. First, the control unit 52 determines whether an operation starts (100).

When it is determined that the operation starts, the control unit 52 reads a feedback sound (for example, an event effect sound) to inform of the start of the operation from the storage unit 54 and outputs the read feedback sound through the sound output unit 38 (102). At this time, feedback sound output time is predetermined by the control unit such that the feedback sound is outputted for the predetermined time, whereby it is possible to inform the user that the operation starts while the power consumption is reduced.

Also, the waveform of the feedback sound to inform the user that the operation starts is displayed through the display unit 34 mounted at the control panel 30, so that the user is visually satisfied.

Subsequently, the operation, i.e., water supply, washing, rinsing, drainage, spin-drying, drying, wrinkle removal, etc., of the washing machine is performed (104), and noise generated during the operation progress of the washing machine is sensed by the noise sensing unit 50 (106).

The noise generated during the operation of the washing machine is repeatedly generated with a specific pattern, as shown in FIGS. 3 to 6, according to each operation.

For example, during water supply, as shown in FIG. 3, noise (mechanical noise) may have a specific frequency characteristic of a 1.2 KHz band (a repetitive cycle of 18 seconds), for example. Consequently, the control unit 52 analyzes the pattern of the noise inputted from the noise sensing unit 50 (108) to determine which operation is being performed.

After analyzing the noise pattern generated differently according to each operation, the control unit 52 reads a sound (for example, a background sound) to cancel the analyzed noise pattern from the storage unit 54 and outputs the read sound through the sound output unit 38 (110). A canceling sound corresponding to each noise pattern is previously stored in the storage unit 54. Consequently, the control unit 52 reads a canceling sound corresponding to the analyzed noise pattern from the storage unit 54 and outputs the read canceling sound, in a state in which the canceling sound is mapped with the noise pattern, to mask the noise generated during the operation of the washing machine and thus minimize the noise.

Figure 9:
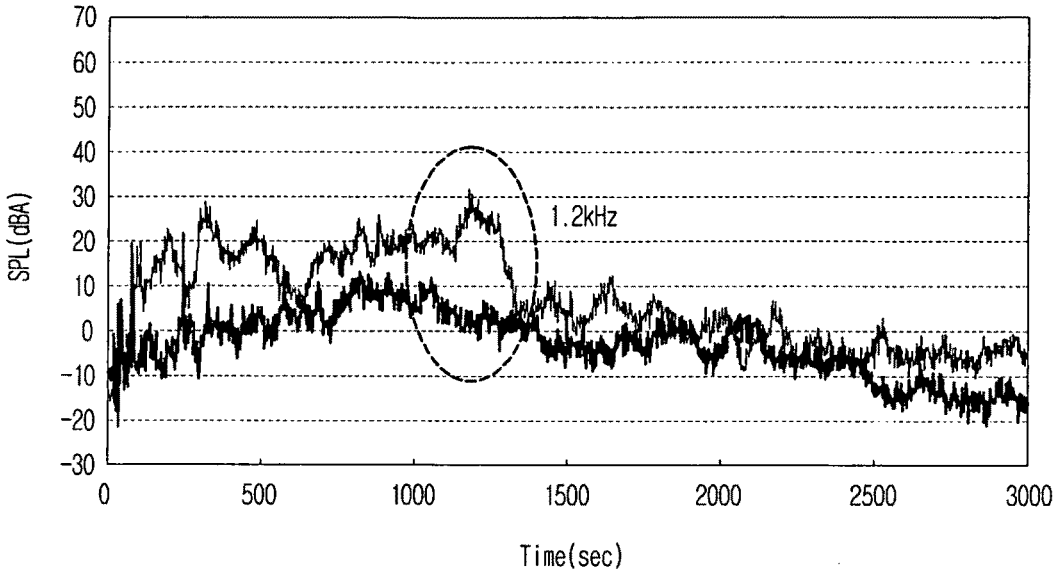
FIG. 9 is a graph illustrating the pattern of a sound to cancel noise generated during water supply.

For example, during water supply, as shown in FIG. 9, a canceling sound having a specific frequency characteristic of a 1.2 KHz band or higher (a repetitive cycle of 18 seconds), for example, is mapped to mask noise generated during the water supply. During washing, a canceling sound having a regular pattern of 20 to 30 dBA every two seconds, for example, is mapped to mask noise generated during the washing. During drainage, a canceling sound having 40 dBA of 120 Hz, for example, is mapped at the beginning of the drainage to mask noise generated during the drainage.

At this time, the waveform of the outputted canceling sound is displayed through the display unit 34 mounted at the control panel 30, so that the user is visually satisfied.

The canceling sound mapped using such a masking effect is a sound that is capable of providing an appropriate mood while not affecting the surrounding environment. The canceling sound must be provided in the form of a background sound that can delicately inform a user that the washing machine is operating, unlike music, but must not be strong to the extent that the canceling sound becomes a main sound. This is because the user must not feel the sound provided to cancel the noise generated during the operation progress of the washing machine to be another noise.

The control unit 52 may be designed to continuously output the canceling sound during the operation progress of the washing machine. Even in this case, the control unit 52 may be designed to output the canceling sound only at a frequency band at which the user can perceive by hearing from the noise pattern such that the user is prevented from feeling that the canceling sound is another noise.

During the cancellation of the noise generated during the operation progress of the washing machine, the control unit 52 continuously analyzes the pattern of the noise inputted from the noise sensing unit 50 to determine whether the operation has changed (112).

When the operation has changed, the control unit 52 reads a feedback sound (for example, an event effect sound) to inform of the change of the operation from the storage unit 54 and outputs the read feedback sound through the sound output unit 38 (114). At this time, the noise canceling sound and the feedback sound of the present operation are coupled and outputted to inform a user that the operation has changed.

The feedback sound informing of the change of the operation may be the same as or different from the feedback sound informing of the start of the operation at operation 102. This is possible by constructing information of feedback sounds stored in the storage unit 54 in the form of a database. At this time, the waveform of the outputted feedback sound is displayed through the display unit 34 mounted at the control panel 30, so that a user is visually satisfied.

Subsequently, the user sensing unit 36 senses whether a user has accessed the washing machine during the operation progress of the washing machine (116). When the user's access is sensed, the control unit 52 reads a feedback sound to inform of the progress state of the operation from the storage unit 54 and outputs the read feedback sound through the sound output unit 38 (118). At this time, the noise canceling sound and the feedback sound (for example, the event effect sound) of the present operation are coupled and outputted, so that it is possible for the user to confirm which operation is being performed without the user's access to the washing machine.

The feedback sound informing of the progress state of the operation may be the same as or different from the feedback sound informing of the start of the operation at operation 102 or the feedback sound informing of the change of the operation at operation 114. When a different sound is used, a specific sound for each operation is stored in the storage unit 54 in the form of a database. At this time, the waveform of the outputted feedback sound is displayed through the display unit 34 mounted at the control panel 30, so that a user is visually satisfied.

Subsequently, the control unit determines whether the operation has been completed (120). When it is determined that the operation has not been completed, the procedure returns to operation 104, and the subsequent process is repeatedly carried out.

When it is determined that the operation has been completed, the control unit 52 reads a feedback sound (for example, an event effect sound) to inform of the end of the operation from the storage unit 54 and outputs the read feedback sound through the sound output unit 38 (122).

The feedback sound informing of the end of the operation may be the same as or different from the feedback sound informing of the start of the operation at operation 102, the feedback sound informing of the change of the operation at operation 114, or the feedback sound informing of the progress state of the operation at operation 118.

Meanwhile, the embodiment is described in connection with the washing machine. However, the present embodiment is not limited to the washing machine but is applicable to any electric home appliances, such as dish washers or driers, performing a series of operations.

As apparent from the above description, the washing machine and the sound control method thereof according to the present embodiment are capable of sensing a pattern of noise generated during the operation of the washing machine and mapping the noise pattern with a noise canceling sound to mask the noise. Consequently, the present embodiment has the effect of minimizing the noise. Also, the washing machine and the sound control method thereof according to the present embodiment are capable of sensing the start and end of each operation and the change of the operation based on the noise pattern, sensing a user's access to the washing machine, and outputting a feedback sound. Consequently, the present embodiment has the effect of informing the user of the progress information of the washing machine.

Although an embodiment has been shown and described, it would be appreciated by those skilled in the art that changes may be made in this embodiment without departing from the principles and spirit of the invention, the scope of which is defined in the claims and their equivalents.

What is claimed is:

1. A sound control method for a washing machine, the sound control method comprising:

a washing operation, a rinsing operation and a spin-drying operation for cleaning a laundry, wherein the washing operation further comprises a water supply cycle, a washing cycle, a drainage cycle, and an intermediate spin-drying cycle, the rinsing operation further comprises a water supply cycle, a rinsing cycle, a drainage cycle, and an intermediate spin-drying cycle, and the spin-drying operation further comprises a final spin-drying cycle, wherein the sound control method comprises:

sensing which one is a current operation cycle of the washing machine among the water supply cycle, the washing cycle, the drainage cycle, and the intermediate spin-drying cycle of the washing operation; the water supply cycle, the rinsing cycle, the drainage cycle, and the intermediate spin-drying cycle of the rinsing operation; and the final spin-drying cycle of the spin-drying operation;

sensing noise generated during the sensed operation cycle of the washing machine;

analyzing the sensed noise;

selecting a canceling sound corresponding to the analyzed noise from a storage unit configured to store a plurality of pieces of canceling sound;

outputting the selected canceling sound; and masking the noise by mapping the output canceling sound to the noise generated during the operation cycle of the washing machine.

2. The sound control method according to claim 1, wherein the operation of the washing machine further comprises a drying cycle or a wrinkle removal cycle, and wherein the sensing of the noise includes sensing noise generated during the drying cycle or the wrinkle removal cycle.

3. The sound control method according to claim 2, wherein the sensing of the noise includes sensing a pattern of the noise generated during each operation cycle of the washing machine.

4. The sound control method according to claim 3, wherein the sensed noise pattern is specific to each operation cycle.

5. The sound control method according to claim 3, wherein the selecting of the canceling sound includes reading information of the canceling sound previously stored in the storage unit according to the noise pattern.

6. The sound control method according to claim 5, wherein the canceling sound is a background sound or melody having an amplitude greater than that of the noise.

7. The sound control method according to claim 5, wherein the outputting of the canceling sound includes reading a canceling sound corresponding to the noise pattern from the storage unit and outputting the read canceling sound.

8. The sound control method according to claim 5, further comprising:

sensing whether abnormal noise is generated according to the noise pattern, wherein the outputting of the canceling sound includes reading or creating a canceling sound corresponding to the noise pattern from the storage unit and outputting the read or created canceling sound when sensed that abnormal noise is generated.

9. The sound control method according to claim 8, wherein the created sound is obtained by adjusting the magnitude of the canceling sound according to the magnitude of the abnormal noise.

10. The sound control method according to claim 1, further comprising outputting a feedback sound having a frequency band different from a frequency band of the read canceling sound.

11. The sound control method according to claim 10, further comprising:

sensing access of a user to a vicinity of the washing machine; and outputting the feedback sound to inform of a progress state of the operation cycle when the access of the user is sensed.

12. The sound control method according to claim 10, wherein the feedback sound is an event effect sound or melody.

13. The sound control method according to claim 10, wherein the feedback sound is outputted at one of a start of the operation cycle, an end of the operation cycle, and a change in the operation to inform a user of one of the start of an operation cycle, the end of the operation cycle, and the change in the operation cycle.

14. A washing machine, comprising:

a washing operation, a rinsing operation and a spin-drying operation for cleaning a laundry, wherein the washing operation further comprises a water supply cycle, a washing cycle, a drainage cycle, and an intermediate spin-drying cycle, the rinsing operation further comprises a water supply cycle, a rinsing cycle, a drainage cycle, and an intermediate spin-drying cycle, and the spin-drying operation further comprises a final spin-drying cycle, wherein the washing machine further comprises:

a noise sensing unit configured to sense noise generated during the operation cycle of the washing machine;

a storage unit configured to analyze the noise generated during the operation cycle of the washing machine and select a canceling sound corresponding to the analyzed noise from a plurality of pieces of canceling sound stored in the storage unit;

a sound output unit configured to output the selected canceling sound; and a control unit configured to mask the noise by mapping the output canceling sound to the sensed noise.

15. The washing machine according to claim 14, further comprising a drying cycle or a wrinkle removal cycle, wherein the noise sensing unit senses noise generated during the drying cycle or the wrinkle removal cycle.

16. The washing machine according to claim 15, wherein the noise sensing unit senses a pattern of the noise generated during each operation cycle of the washing machine.

17. The washing machine according to claim 16, wherein the control unit reading the canceling sound corresponding to the noise pattern from the storage unit and outputting the canceling sound in a state in which the canceling sound is mapped to a beginning of the noise pattern.

18. The washing machine according to claim 14, further comprising:

a display unit to display a waveform of the outputted sound.

19. The washing machine according to claim 15, further comprising:

a user sensing unit to sense access of a user to a vicinity of the washing machine, the control unit reading and outputting a feedback sound to inform of a progress state of the operation cycle of the washing machine from the storage unit when the access of the user is sensed.

20. A sound control method for a washing machine, the sound control method comprising:

performing a washing operation, a rinsing operation and a spin-drying operation for cleaning a laundry;

sensing which one is a current operation cycle of the washing machine among a water supply cycle, a washing cycle, a drainage cycle, and an intermediate spin-drying cycle of the washing operation, a water supply cycle, a rinsing cycle, a drainage cycle, and an intermediate spin-drying cycle of the rinsing operation, and a final spin-drying cycle of the spin-drying operation;

sensing noise generated during the sensed operation cycle of the washing machine;

analyzing the sensed noise;

selecting a canceling sound corresponding to the analyzed noise from a storage unit configured to store a plurality of pieces of canceling sound;

outputting the selected canceling sound;

masking the noise by mapping the output canceling sound to the noise generated during the operation cycle of the washing machine;

sensing presence of a user at a vicinity of the washing machine; and outputting a feedback sound to inform of a progress state of the operation cycle of the washing machine when the presence of the user is sensed.

21. The sound control method according to claim 20, further comprising: outputting a feedback sound to inform a user of a progress of the operation cycle if sensed one of a start of the operation cycle, an end of the operation cycle, a change in the operation cycle, and the presence of the user at the vicinity of the washing machine.

22. The sound control method according to claim 20, wherein the canceling sound is mapped with the sensed noise based on an amplitude of the sensed noise.

23. The sound control method according to claim 20, wherein a specific stored canceling noise is mapped to a specific sensed noise.

24. The sound control method according to claim 20, further comprising, if sensed one of a start of the operation cycle, an end of the operation cycle, a change in the operation cycle, the presence of the user at the vicinity of the washing machine, outputting a stored feedback sound having a frequency band different from a frequency band of the canceling sound when informing of a progress state of the operation cycle.

* * * * *

UNITED STATES PATENT AND TRADEMARK OFFICE

CERTIFICATE OF CORRECTION

PATENT NO. : 8,561,437 B2
APPLICATION NO. : 12/232256
DATED : October 22, 2013
INVENTOR(S) : Joo Yeon Lee et al.

It is certified that error appears in the above-identified patent and that said Letters Patent is hereby corrected as shown below:

On the Title Page, In Column 2 (Attorney, Agent, or Firm), Line 1, Delete "Staas & Halsey" and insert -- Staas & Halsey LLP --, therefor.

Signed and Sealed this
Eighteenth Day of February, 2014

Michelle K. Lee

Michelle K. Lee
*Deputy Director of the United States Patent and Trademark Office*